US009387351B2

(12) United States Patent
Auston et al.

(10) Patent No.: US 9,387,351 B2
(45) Date of Patent: Jul. 12, 2016

(54) SUPPORT POST ASSEMBLY FOR A SAFETY LINE SYSTEM

(75) Inventors: Oliver Auston, Ashford (GB); Duncan Barrier, Faversham (GB)

(73) Assignee: Checkmate Limited, Sheerness (GB)

( * ) Notice: Subject to any disclaimer, the term of this patent is extended or adjusted under 35 U.S.C. 154(b) by 949 days.

(21) Appl. No.: 13/468,245

(22) Filed: May 10, 2012

(65) Prior Publication Data

US 2012/0286128 A1 Nov. 15, 2012

(30) Foreign Application Priority Data

May 10, 2011 (GB) ..... 1107746.8

(51) Int. Cl.
*A62B 35/04* (2006.01)
*A62B 35/00* (2006.01)

(52) U.S. Cl.
CPC ..... *A62B 35/04* (2013.01); *A62B 35/0068* (2013.01); *A62B 35/0056* (2013.01)

(58) Field of Classification Search
CPC ..... A62B 35/0068; A62B 35/04
See application file for complete search history.

(56) References Cited

U.S. PATENT DOCUMENTS

| | | | | |
|---|---|---|---|---|
| 5,458,214 | A | 10/1995 | Olson et al. | |
| 6,551,041 | B2 * | 4/2003 | Choate | 411/348 |
| 7,104,371 | B2 * | 9/2006 | Renton | 188/371 |
| 7,207,414 | B2 * | 4/2007 | Luke et al. | 182/3 |
| 2004/0050620 | A1 | 3/2004 | Luke et al. | |
| 2004/0256176 | A1 * | 12/2004 | Argoud | 182/45 |
| 2008/0251320 | A1 * | 10/2008 | Lara | 182/192 |
| 2008/0277557 | A1 * | 11/2008 | Vetesnik et al. | 248/499 |

FOREIGN PATENT DOCUMENTS

| | | | |
|---|---|---|---|
| AU | 2006225203 | 4/2007 | |
| GB | 2 354 052 | 3/2001 | |
| GB | 2 466 054 | 6/2010 | |
| WO | 94/08658 | 4/1994 | |
| WO | 02/43809 | 6/2002 | |
| WO | WO 2005079922 A1 * | 9/2005 | A62B 35/04 |
| WO | 2008/041851 | 4/2008 | |

OTHER PUBLICATIONS

Extended European Search Report from a corresponding European patent application bearing a mailing date of Jan. 27, 2014, 5 pages.

* cited by examiner

*Primary Examiner* — Charles A Fox
*Assistant Examiner* — Kristine Florio
(74) *Attorney, Agent, or Firm* — Burr & Brown, PLLC

(57) ABSTRACT

A support post assembly for a safety line system for a workman at a height above the ground. The assembly comprises a support post, a safety line mount to which a safety line may be secured, and a shock absorber. The support post has opposite first and second ends, a post axis extending therebetween, and at the first end, a base portion for fixing the assembly to a supporting surface. The safety line mount extends away from the second end of the support post. The shock absorber is within the support post between the ends of the support post, the shock absorber comprising a pivot, such that in the event of a fall by a worker secured to the safety line, lateral forces imparted to the safety line mount by the fall are transmitted to the shock absorber, causing the shock absorber to deflect laterally relative to the post axis.

18 Claims, 7 Drawing Sheets

SUPPORT POST ASSEMBLY FOR A SAFETY LINE SYSTEM

BACKGROUND a. Field of the Invention

This invention relates to safety line system for use by a workman working at a height above the ground. In particular the invention relates to a support post for a safety line system.

b. Related Art

While a worker is working at height he will typically be connected to a secure mounting by means of a lifeline attached to a harness. In particular, in many circumstances, a secure safety line or rail is provided across or around the raised area in which the workers are working.

The workers are attached to this safety rail by means of a lanyard attached at one end to a harness or similar worn by each worker and at the other end to a traveller engaged with and able to slide along the safety line or rail. As such, as the worker moves around, the traveller is pulled along the safety rail by the lanyard so as to follow the worker around the area.

The safety line or rail is typically mounted on and supported by a number of support posts at intervals along its length. Support posts may be provided, in particular, at corners, so as to provide a means for guiding the line smoothly around the corner. The support posts, therefore, are required to maintain the safety line or rail in the desired position while allowing the workers to move around relative to the line or rail.

The problem with these systems is that, when a workman falls, although some of the energy of the fall may, for example, be absorbed by the lanyard, the relative rigidity of the support posts means that little energy is absorbed by these supports.

It is, therefore, an object of the present invention to provide an improved safety line support able to absorb some of the energy from the fall of a worker secured to the safety line.

SUMMARY OF THE INVENTION

According to the invention there is provided a support post assembly for supporting a fall safety line, the support post assembly comprising:

- a support post having opposite first and second ends, an axis extending between said ends, and at said first end, a base portion for fixing the assembly to a supporting surface;
- a safety line mount to which a safety line may be secured, the safety line mount extending away from the second end of the support post; and
- a shock absorber housed within the support post between said first and second ends, the shock absorber comprising a pivot, such that in the event of a fall by a worker secured to said safety line, lateral forces imparted to the safety line mount by the fall are transmitted to the shock absorber thereby causing the shock absorber to deflect laterally with respect to said axis, wherein the pivot is connected to the base portion and located between said first and second ends of the support post, the shock absorber having a first portion and a second portion and said first and second portions of the shock absorber being located on, respectively, opposite first and second sides of the pivot, said lateral deflection causing at least a part of both said first and second portions to rotate about the pivot so that both said first and second portions of the shock absorber absorb energy from the fall.

In preferred embodiments of the invention, the base portion is connected to a plate and the pivot comprises an aperture in this plate, a pin passing through the aperture to form the pivot.

The pivot may therefore comprise a pivot plate connected to the base portion and located between the first and second ends of the support post, the pivot plate having opposite first and second sides, a first portion of the shock absorber being located on the first side of the pivot plate and a second portion of the shock absorber being located on the second side of the pivot plate. In preferred embodiments of the invention, the pivot pate is an end plate or cap connected to a cylindrical base portion and located between the first and second ends of the support post.

In preferred embodiments of the invention, the shock absorber links the safety line mount to the base portion of the post.

Preferably the shock absorber links the safety line mount to the base portion of the post so that forces imparted on the safety line mount are only transmitted to the base portion after transmission through the shock absorber.

In order to increase the possible deflection of the shock absorber and therefore increase the amount of energy that is absorbed, preferably the shock absorber extends along the axis of the post.

To control the deflection of the shock absorber, the shock absorber comprises a pivot. In such an arrangement, in the event of a fall by a worker secured to the safety line, the lateral forces imparted to the safety line mount cause at least a part of the shock absorber to rotate about the pivot. A first part of the shock absorber is located on one side of the pivot and a second part of the shock absorber is located on the other side of the pivot. In this way, a maximum amount of energy can be absorbed while minimising the extent of the lateral deflection of the shock absorber. This allows the diameter or lateral dimensions of the post to be minimised so that the support post does not take up too much space in the area in which the workers are working.

Preferably the safety line mount comprises a base plate, the base plate defining the second end of the support post, and the shock absorber linking the base plate to the base portion of the post. The base plate allows the forces due to a fall to be transmitted evenly to the shock absorber. Preferably the shock absorber comprises a pair of resilient blocks, and the energy from the fall is absorbed by deformation of the resilient blocks.

In preferred embodiments of the invention, the first and second portions of the shock absorber are, respectively, first and second resilient blocks. Deformation of each resilient block therefore absorbs at least some of the energy from the fall. It is preferable if the shock absorber further comprises a pin that has opposite first and second ends, the pin being connected at a first end to the safety line mount and extending through the first and second resilient blocks and engaging with the pivot, the pin pivoting about the pivot in the event of a fall by a worker. The pin then connects the resilient block to the pivot plate or end plate of the base portion. In the event of a fall by a worker secured to the safety line, the lateral forces imparted to the safety line mount cause the pin to rotate about the pivot thereby transmitting the forces to the first and second resilient blocks such that the blocks absorb at least some of the energy of the fall. The pin provides a rigid support for the resilient blocks so that the forces are transmitted evenly through the blocks and the deflection of the blocks is controlled through the depth of each block.

The shock absorber may further comprise a deformable plate-like member attached at a second end of the pin. The plate-like member is arranged such that, in the event of a fall by a worker secured to the safety line, pivoting of the pin about the pivot plate causes the deformable plate to deform thereby absorbing at least some of the energy of the fall.

Each of the resilient blocks may have a pair of opposite end faces, each of these end faces extending transversely to the axis of the support post. A first one of the end faces is fixed in place at the pivot and a second one of the end faces is free to rotate about the pivot when the resilient blocks deform to absorb said energy from the fall.

The support post assembly preferably comprises a housing for the shock absorber, the housing having an inner surface inside of which the shock absorber is housed. Each resilient block then has, between the end faces, an outer surface, at least a portion of this outer surface being spaced apart from the inner surface of the housing to provide a cavity with space to permit the movement of the resilient blocks as the second end faces of the blocks rotate about the pivot.

In preferred embodiments of the invention, parts of both the first and second portions of the shock absorber are compressed by the rotation as the shock absorber absorbs energy from the fall. The first and second portions of the shock absorber may advantageously be symmetrically disposed about the pivot. Symmetrically opposite parts of the first and second portions of the shock absorber are then compressed by the rotation as the shock absorber absorbs energy from the fall.

Depending on the location of the support post assembly relative to the area in which the workers are working, and in particular whether the support post assembly is mounted to a horizontal or vertical surface, the safety line mount may extend away from the second end of the post in a direction parallel to the axis of the post, or alternatively the safety line mount may extend away from the second end of the post in a direction at an angle to the axis of the post. In some embodiments the safety line mount extends away from the second end of the post in a direction perpendicular to the axis of the post.

To protect the shock absorber from weather and other factors that may cause the shock absorber to deteriorate, for example wear or degrade, the support post preferably comprises an outer wall surrounding the shock absorber. In preferred embodiments the support post comprises an outer sleeve in the form of a tube that fits over and around the support post and protects the shock absorber from the elements.

The outer sleeve therefore extends around the base portion of the support post and extends away from the base portion towards the second end of the support post. The outer sleeve may make a close sliding fit to the base portion of the support post.

When the safety line mount comprises a base plate, the outer sleeve may make a close sliding fit to the base plate at the second end of the support post.

The close sliding fit of the outer sleeve with the base plate and/or the base portion of the support post permits some relative movement of the outer sleeve and the base plate and/or the base portion as the shock absorber housed inside the support post absorber rotates in response to forces imparted by a fall. This prevents damage of the outer sleeve, and also permits the outer sleeve, when this is made of a resilient material, to absorb some of the energy of a fall.

Preferably the base portion of the support post comprises a flange to allow the post to be attached firmly to a supporting surface.

BRIEF DESCRIPTION OF THE DRAWINGS

The invention will now be further described, by way of example only, with reference to the accompanying drawings, in which.

DETAILED DESCRIPTION

Figure 1:
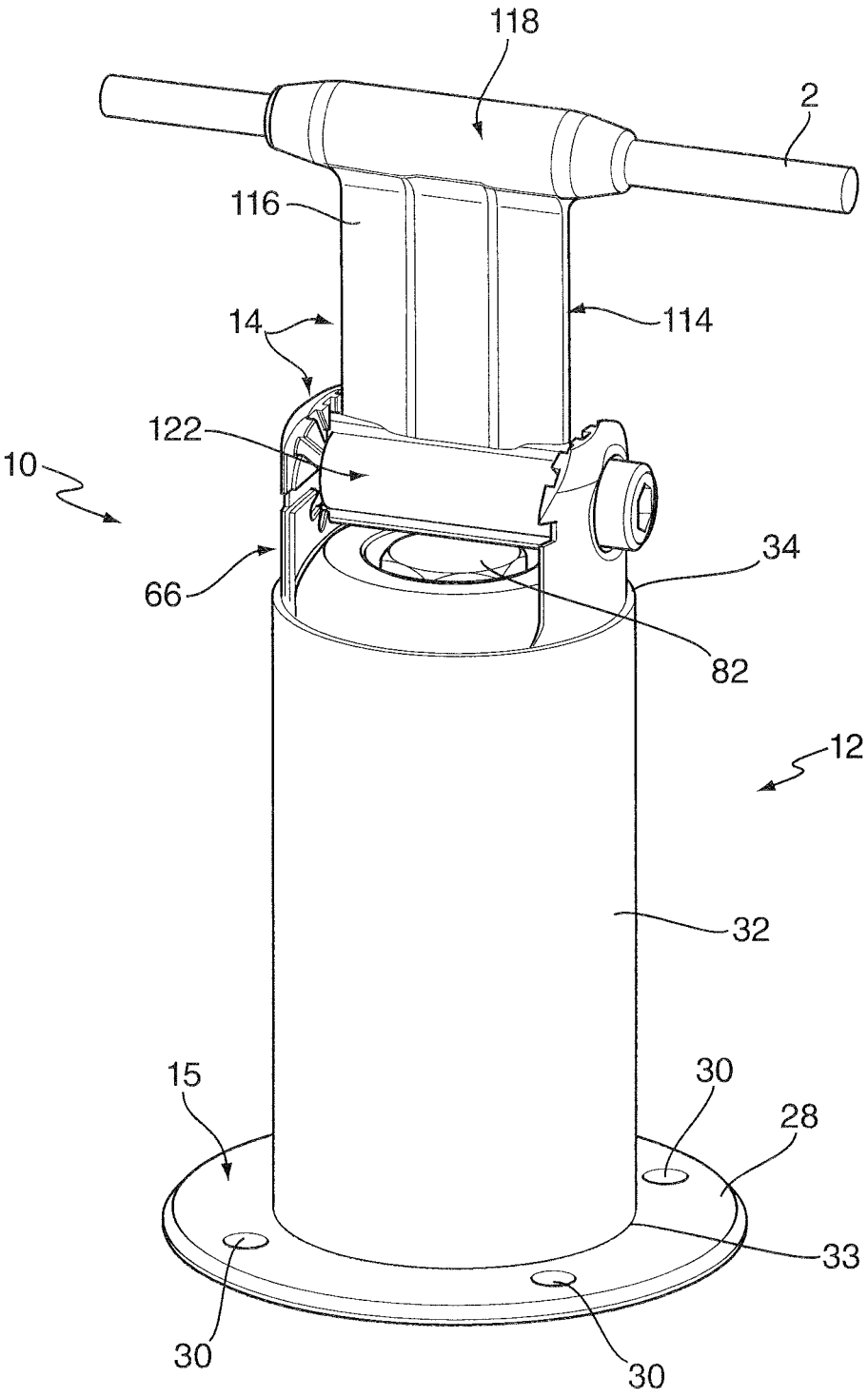
FIG. 1 is a perspective view of a safety line support post assembly according to a first preferred embodiment of the present invention, the support post assembly having a support post and, at one end of the support post, a safety line mount to which a safety line is secured.

FIG. 1 shows a support post assembly 10 for supporting a fall safety line 2 according to a preferred embodiment of the present invention. The support post assembly 10 comprises a support post 12, attachable to the ground or to a structure on which workers are working, and a safety line mount 14 for engagement with the safety line 2.

Figure 2:
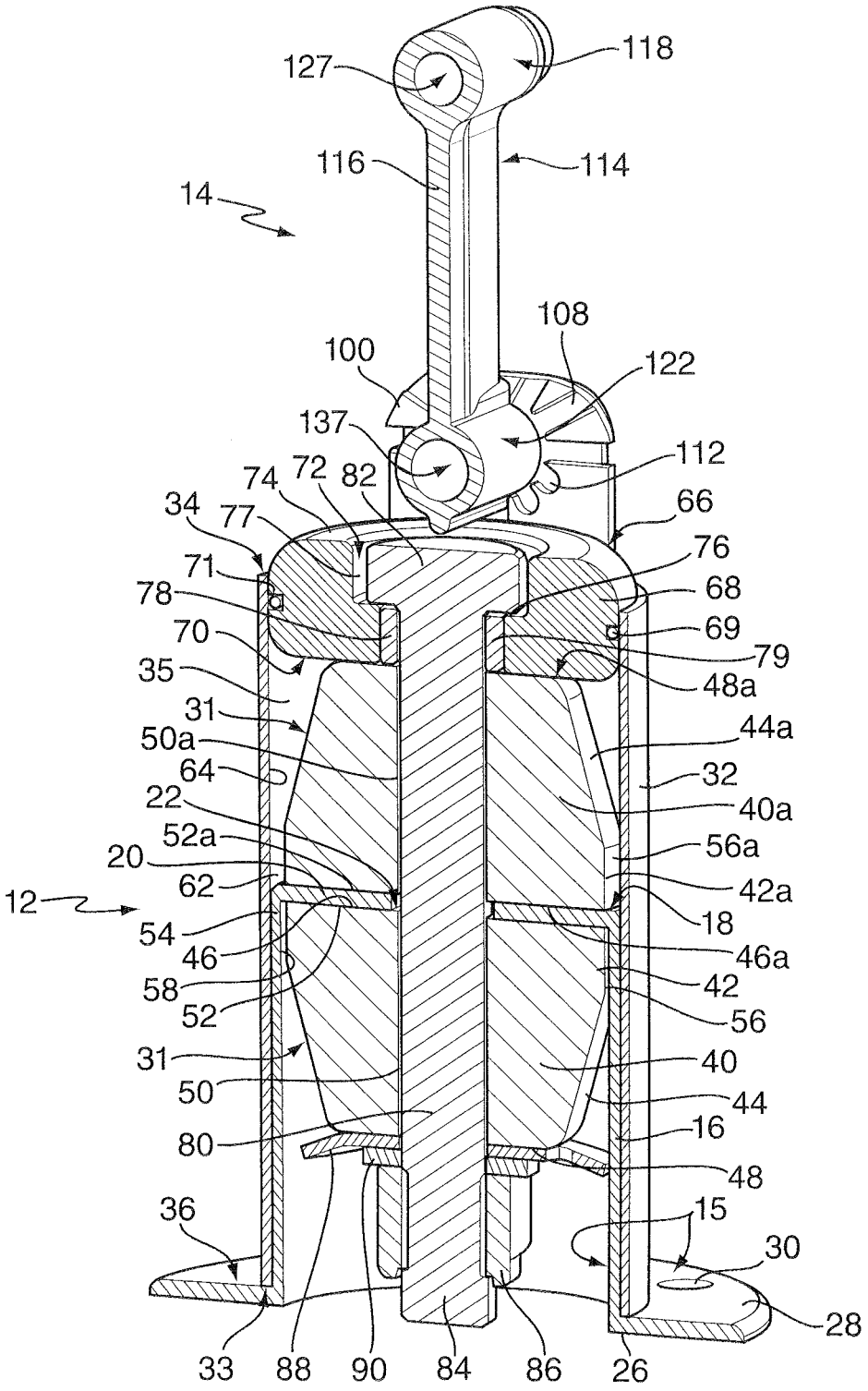
FIG. 2 is a cross-sectional view of the safety line support of FIG. 1 showing the internal structure of the support post assembly.
Figure 3:
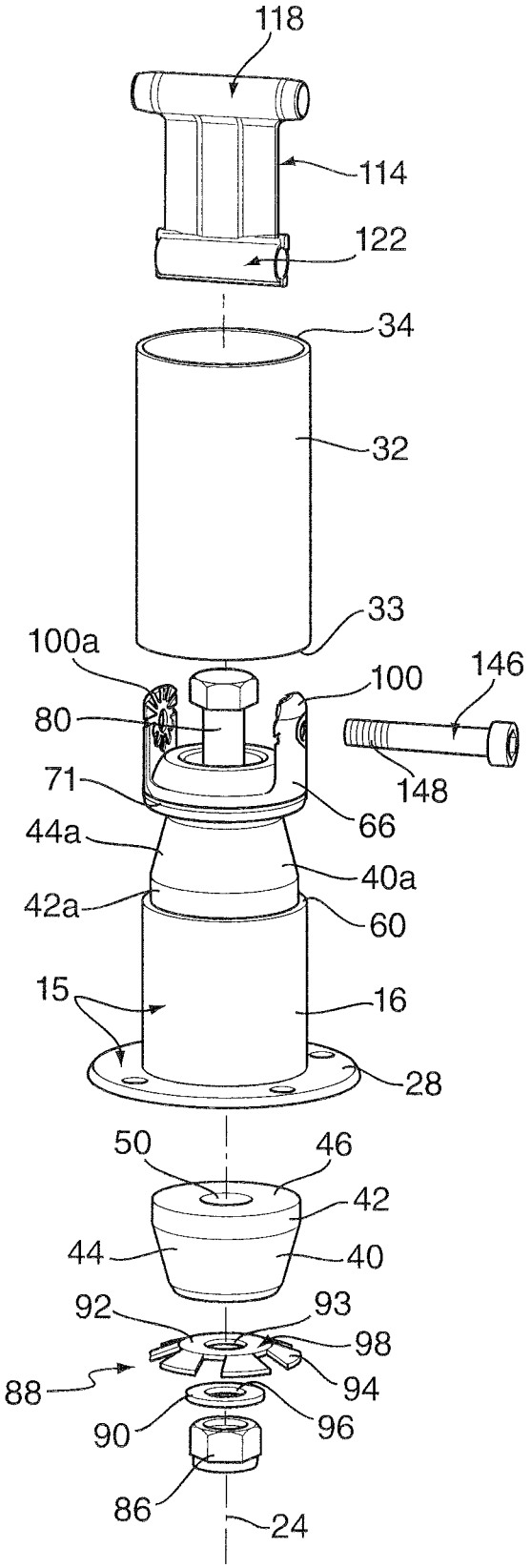
FIG. 3 is an exploded diagram showing the major components of the support post assembly of FIG. 1.

The support post 12 comprises a flanged inner sleeve 16 having a generally cylindrical shape, as shown most clearly in FIGS. 2 and 3. A first end 18 of the inner sleeve 16 is defined by an end plate 20. Apart from a central aperture or hole 22 that is in line with a longitudinal post axis 24 of the support post 12, the end plate substantially closes or blocks the inner sleeve. As will be described in more detail below, the aperture 22 in the end plate 20 serves as a pivot in a shock absorber 31 contained within the support post 12.

At a second end 26 of the inner sleeve 16 a flange 28 extends perpendicularly radially outwards from the sleeve 16 around the full circumference of the sleeve 16. This flange 28 provides attachment means for attaching the support post 12 to the ground or other supporting surface (not shown). In particular, in this example, the flange 28 includes holes 30 spaced around the flange through which bolts or similar (not shown) may be passed to secure the support post 12 in the required location. As such, the inner sleeve 16 and in particular the flange 28 forms a base portion 15 of the support post 12. As will be explained in more detail below, the inner sleeve defines a first cavity 35 for a first portion 40 of the shock absorber 31.

An outer sleeve 32 has a generally cylindrical shape and locates around the inner sleeve 16 in a close sliding fit. As such, an internal diameter of the outer sleeve 32 is approximately equal to an external diameter of the inner sleeve 16 so that the outer sleeve 32 is able to slide onto and around the inner sleeve 16.

When the outer sleeve 32 is located fully over the inner sleeve 16, a first end 33 of the outer sleeve 32 abuts a face 36 of the flange 28. The length of the outer sleeve 32 is significantly greater than the length of the inner sleeve 16 so that a second end 34 of the outer sleeve 32 extends beyond the first end 18 of the inner sleeve 16 thereby defining a second cavity 35*a* for a second portion 40*a* of the shock absorber 31. In this way, the end plate 20 of the inner sleeve 16 forms a cross-plate 20 midway along the length of the support post 12.

As such, the length of the outer sleeve 32 is typically 1.5 to 2 times the length of the inner sleeve 16. In a preferred embodiment the outer sleeve 32 is formed from a thin-walled tube of stainless steel. The inner and outer sleeves 16, 32 form an outer wall of the support post 12 and provide a housing for the shock absorber 31 contained within the support post 12.

The support post 12 therefore further comprises the shock absorber 31 which in this embodiment comprises two resilient inserts 40, 40*a* positioned on opposite sides of the end plate 20. Preferably the inserts 40, 40*a* are identical and are generally cylindrical, but frusto-conical at one end. A first portion 42, 42*a* of the inserts 40, 40*a* has a constant outer diameter and a second portion 44, 44*a*, continuous with the first portion 42, 42*a*, has a tapered outer surface, such that a first end 46, 46*a* of the inserts 40, 40*a* in contact with corresponding opposite sides 52, 52*a* of the end plate 20 has a larger diameter than a second end 48, 48*a* of the inserts 40, 40*a*. A cylindrical bore 50, 50*a* extends centrally through each of the inserts 40, 40*a* from the first end 46, 46*a* to the second end 48, 48*a*. The diameter of the bore 50, 50*a* is preferably the same size as or slightly smaller than the diameter of the aperture 22 in the end plate 20 of the inner sleeve 16.

The resilient inserts 40, 40*a* are preferably made of an elastomeric material, for example an ethylene propylene rubber. In a preferred embodiment of the invention the inserts are made from an ethylene propylene diene monomer (EPDM) rubber, which has good tear and abrasion resistance as well as good weather resistance.

A first of the two inserts 40 is located within the inner sleeve 16 of the support post 12 such that the first end 46 abuts a first, inner face 52 of the end plate 20 and with the bore 50 aligned with the aperture 22 in the end plate 20. The outer diameter of the first end 46 of the insert 40 is slightly smaller than the internal diameter of the inner sleeve 16, such that a minimal gap 54 exists between an outer surface 56 of the first portion 42 of the insert 40 and an inner surface 58 of the inner sleeve 16.

A second of the two inserts 40*a* locates within the second cavity 35*a*, such that the first end 46*a* abuts a second, outer face 52*a* of the end plate 20 of the inner sleeve 16, and with the bore 50*a* aligned with the aperture 22 in the end plate 20. Because, in this embodiment, the first and second inserts 40, 40*a* are identical in shape and size, but the internal diameter of the outer sleeve 32 is larger than the internal diameter of the inner sleeve 16, a larger gap 62 exists between an outer surface 56*a* of the first portion 42*a* of the insert 40*a* and an inner surface 64 of the outer sleeve 32, as compared to the minimal gap 54 between the outer surface 56 of the first portion 42 of the other insert 40 and the inner surface 58 of the inner sleeve 16.

The inserts 40, 40*a* are secured in position within the sleeves 16, 32 and in contact with the end plate 20 by securing means 80 that extends through the bores 50, 50*a* of the inserts 40, 40*a* and the aperture 22 in the end plate 20 as will be described below.

In this embodiment, a mounting collar or carriage 66 of the safety line mount 14 forms a cap at the second end 34 of the outer sleeve 32. The mounting collar 66 comprises a substantially disc-shaped base plate 68 having an external diameter approximately equal to the internal diameter of the outer sleeve 32. There is a tight fit of the base plate 68 within the second end 34 of the outer sleeve 32 so that the resilient inserts 40, 40*a* contained within the sleeve are protected from the weather for example. Preferably a seal is formed between the base plate 68 and the outer sleeve 32. The seal may be formed by an O-ring 69 located in a groove 71 in the base plate 68 between a circumferential edge 104 of the base plate 68 and the inner surface 64 of the outer sleeve 32.

When the mounting collar 66 is fully inserted into the second end 34 of the outer sleeve 32, a first, inner face 70 of the base plate 68 abuts the second end 48*a* of the insert 40*a* in the second cavity 35*a*.

A hole 72 extends through the base plate 68 between the first, inner face 70 and a second, opposing outer face 74. The hole 72 includes a shoulder 76 approximately halfway between the first and second faces 70, 74, such that a first section 77 of the hole 72 proximate the second face 74 has a larger diameter than a second section 78 proximate the first face 70. In this way, the first section 77 forms a recess for receiving a head 82 of a pin or bolt 80, as will be described below.

The diameter of the second section 78 of the hole 72 is wider than that of the bolt, so that a sleeve 79 can be fitted between the shaft of the bolt and the second section 78 of the hole 72. The sleeve 79 has an inner diameter approximately equal to the diameter of the bores 50, 50*a* through the inserts 40, 40*a* and when the mounting collar 66 is inserted in the second end 34 of the outer sleeve 32, the hole 72 and sleeve 79 align concentrically with the bores 50, 50*a* along the longitudinal axis 24 of the support post 12.

To secure the mounting collar 66 and inserts 40, 40*a* within the support post 12, a bolt 80 is inserted through: the hole 72 in the mounting collar 66; the sleeve 79; the bore 50*a* in the insert 40*a* nearest the collar; the aperture 22 in the end plate 20; and the bore 50 in the insert 40 further from the collar. When fully inserted, the head 82 of the bolt 80 sits within the first section 77 of the hole 72 and an end 84 of the bolt 80 protrudes beyond the second end 48 of the innermost insert 40.

At least the end 84 of the bolt is threaded, and a nut 86 is used to secure the bolt 80 within the support post 12. In this embodiment, two plates or washers 88, 90 are fitted onto the end 84 of the bolt 80 before the nut 86 so that the washers 88, 90 are positioned between the end 48 of the innermost insert 40 and the nut 86. As shown most clearly in FIG. 3, the first washer 88, in contact with the second end 48 of the innermost insert 40, has a planar disc-shaped central region 92 with a central hole 93 and a plurality of tabs 94 spaced around and extending radially outwards from the circumference of the disc-shaped central region 92. Each of the tabs 94 extends at an angle to the plane of the central region 92 (which lies perpendicular to the post axis 24) so that the washer 88 has a generally dish-shaped cross-section. A second washer 90, sandwiched between the first washer 88 and the nut 86, is substantially identical in size to the central region 92 of the first washer 88. As such the second washer 90 comprises a planar disc having a central hole 96. The diameter of the second washer 90 may be the same as or smaller than the diameter of the central region 92 of the first washer 88.

The first washer 88 is positioned on the end of the bolt 80 so that a first face 98 of the first washer 88 sits against the end 48 of the insert 40 and the tabs 94 extend in a direction away from the insert 40. The second washer 90 is then placed over the end 84 of the bolt 80 and the nut 86 is screwed onto the end 84 of the bolt 80. The nut 86 is then tightened onto the bolt 80 so that the head 82 of the bolt 80 sits on the shoulder 76 in the collar body 68 and the inserts 40, 40*a* are pressed tightly against the end plate 20 of the inner sleeve 16.

Figure 5:
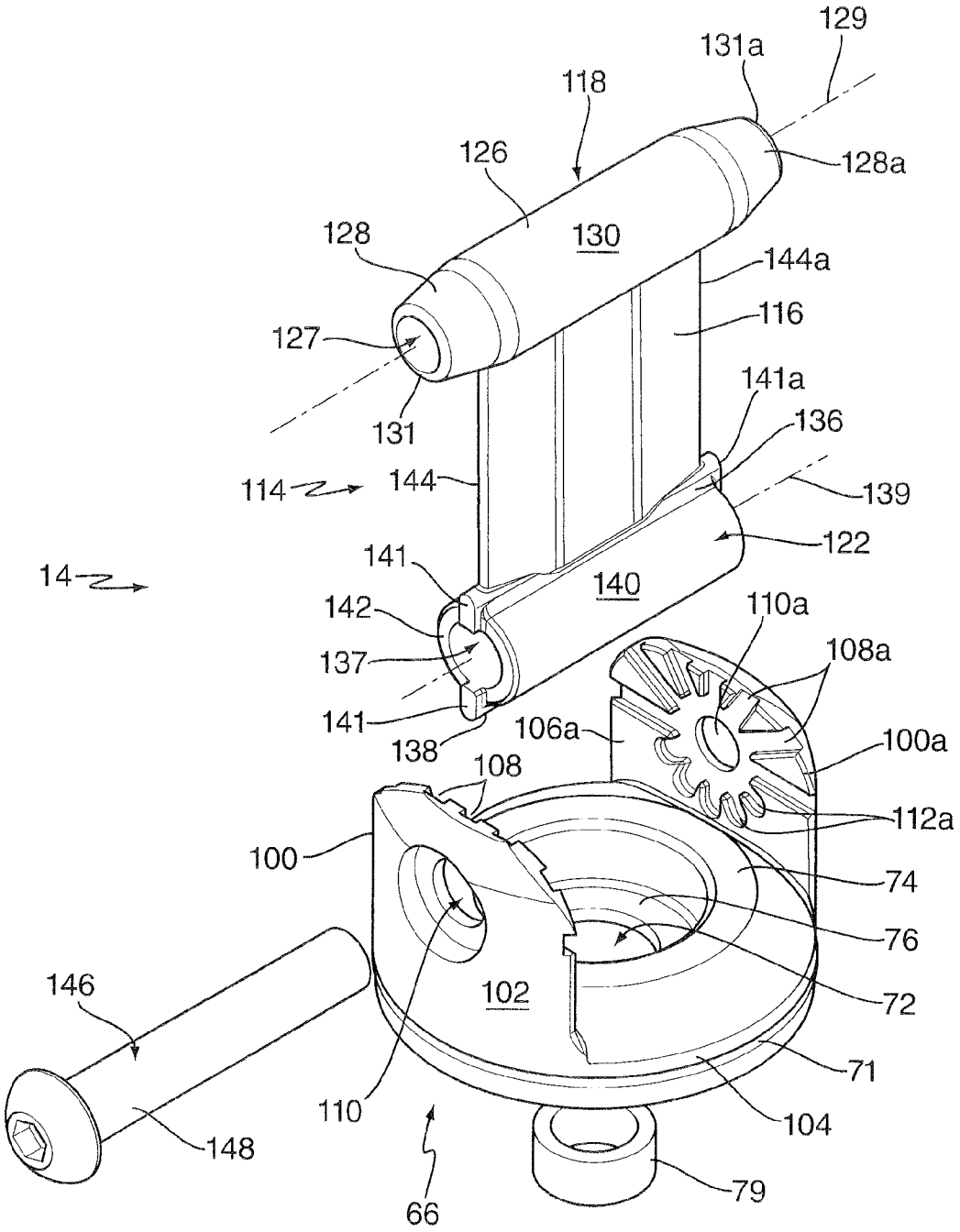
FIG. 5 is an exploded perspective diagram showing the major components of the safety line mount according to a preferred embodiment of the present invention.
Figure 7:
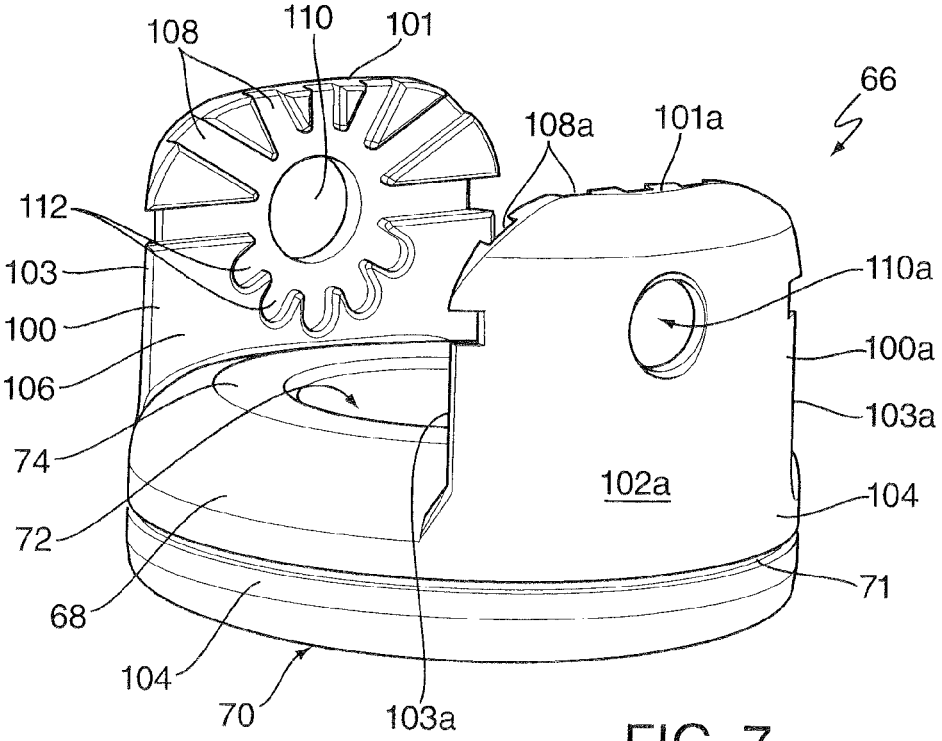
FIG. 7 is a perspective view of a mounting collar of the safety line mount of FIG. 5.

Returning to the mounting collar 66, the collar 66 further comprises two identical arms 100, 100*a*, as shown most clearly in FIGS. 5 and 7. The arms 100, 100*a* extend perpendicularly from the second face 74 of the base plate 68 at the circumference of the base plate 68 and have a top edge 101, 101*a* and two side edges 103, 103*a*. An outer face 102, 102*a* of each of the arms 100, 100*a* is curved and is continuous and integral with the circumferential edge 104 of the base plate 68. The arms 100, 100*a* extend from diametrically opposing portions of the base plate 68 such that the arms 100, 100*a* have opposing inner faces 106, 106*a* that are parallel with each other.

In a preferred embodiment, each of the inner faces 106, 106*a* is substantially rectangular and planar. Each of the inner faces 106, 106*a* of the arms 100, 100*a* further includes a plurality of channels or keyways 108, 108*a* extending across the face 106, 106*a* from the top edge 101, 101*a* or a side edge 103, 103*a*. Each of the channels 108, 108*a* is straight and in the region where the channels would intersect there is a hole 110, 110*a* in each of the arms 100, 100*a* extending fully through each arm 100, 100*a* between the inner and outer faces 106, 106*a*, 102, 102*a*. Each of the channels 108, 108*a* terminates at a respective rounded end 112, 112*a* in a region below the hole 110, 110*a* and proximate the collar body 68.

Figure 6:
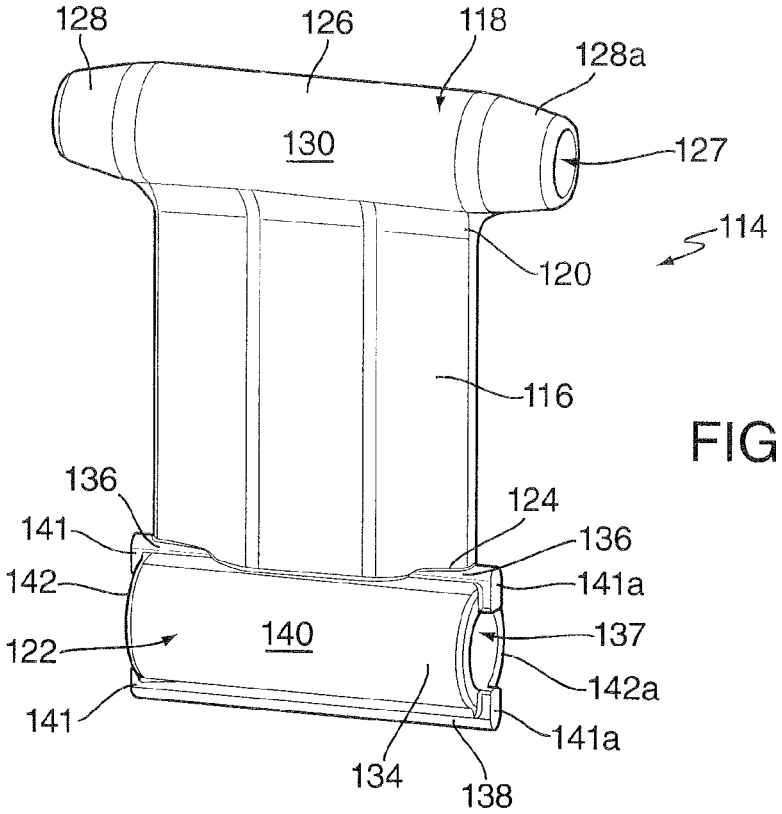
FIG. 6 is a perspective view of the safety line guide member of the safety line mount of FIG. 5.

In addition to the mounting collar 66, the safety line mount 14 further comprises a safety line mounting portion in the form of a safety line guide member 114, as shown in FIGS. 5 and 6. The safety line guide member 114 includes a generally rectangular supporting stem 116, a generally cylindrical line keeper 118 attached at a first end 120 of the supporting stem 116, and a generally cylindrical key 122 attached at a second end 124 of the stem 116 opposite the first end.

The line keeper 118 comprises a central cylindrical portion 126 having a constant external diameter and two tapered end portions 128, 128*a*. A bore 127 of constant diameter extends centrally though the line keeper 118 along a longitudinal axis 129 for receiving the safety line 2. The supporting stem 116 extends radially from an outer surface 130 of the central portion 126 of the line keeper 118, with the plane of the stem 116 parallel to the longitudinal axis 129 of the line keeper. In a preferred embodiment, the width of the supporting stem 116 is approximately equal to the length of the central portion 126.

The key 122 comprises a cylindrical tube 134 having a constant diameter and two projecting ribs 136, 138. A bore 137 of constant diameter extends centrally though the key 122 along a longitudinal axis 139. The ribs 136, 138 project from an outer surface 140 of the tube 134 and extend longitudinally along the tube 134. The length of each of the ribs 136, 138 is longer than the length of the tube 134 so that end portions 141, 141*a* of each of the ribs 136, 138 projects beyond a respective end 142, 142*a* of the tube 134.

The supporting stem 116 extends radially from a first one of the ribs 136. Preferably the width of the supporting stem 116 is less than the length of the tube 134 such that a portion of the rib 136 extends beyond each edge 144, 144*a* of the stem 116.

The supporting stem 116, therefore, forms a bridging member between the key 122 and the line keeper 118 such that the longitudinal axes 139, 129 of the key 122 and line keeper 118 are parallel to but spaced apart from each other.

The length of the key 122 from the first end 142 of the tube 134 to the second end 142*a* is approximately the same as the distance between the opposing inner faces 106, 106*a* of the arms 100, 100*a* of the mounting collar 66. As such there is a sliding fit of the key 122 between the arms 100, 100*a*. The protruding ends 141, 141*a* of the ribs 136, 138 then engage with, and sit within, respective keyways 108, 108*a* in the inner faces 106, 106*a*.

In this way, the key 122 can only be inserted between the arms 100, 100*a* in a limited number of fixed orientations determined by the number and orientation of the keyways 108, 108*a*. When the key 122 is fully inserted in the mounting collar 66, the ends 141, 141*a* of the rib 138 locate within a respective end 112, 112*a* of the keyway channel 108, 108*a*. In addition, the bore 137 in the key 122 aligns with the holes 110, 110*a* in each of the arms 100, 100*a*. A retaining pin 146 is inserted through the holes 110, 110*a* and the bore 137 to prevent the key 122 being pulled out of the mounting collar 66. Preferably at least one of the holes 110, 110*a* has a threaded inner surface (not shown) and at least a portion of the outer surface of the shaft 148 of the pin 146 is threaded, so that the pin 146 can be secured through the arms 100, 100*a* and the key 122.

Figure 4:
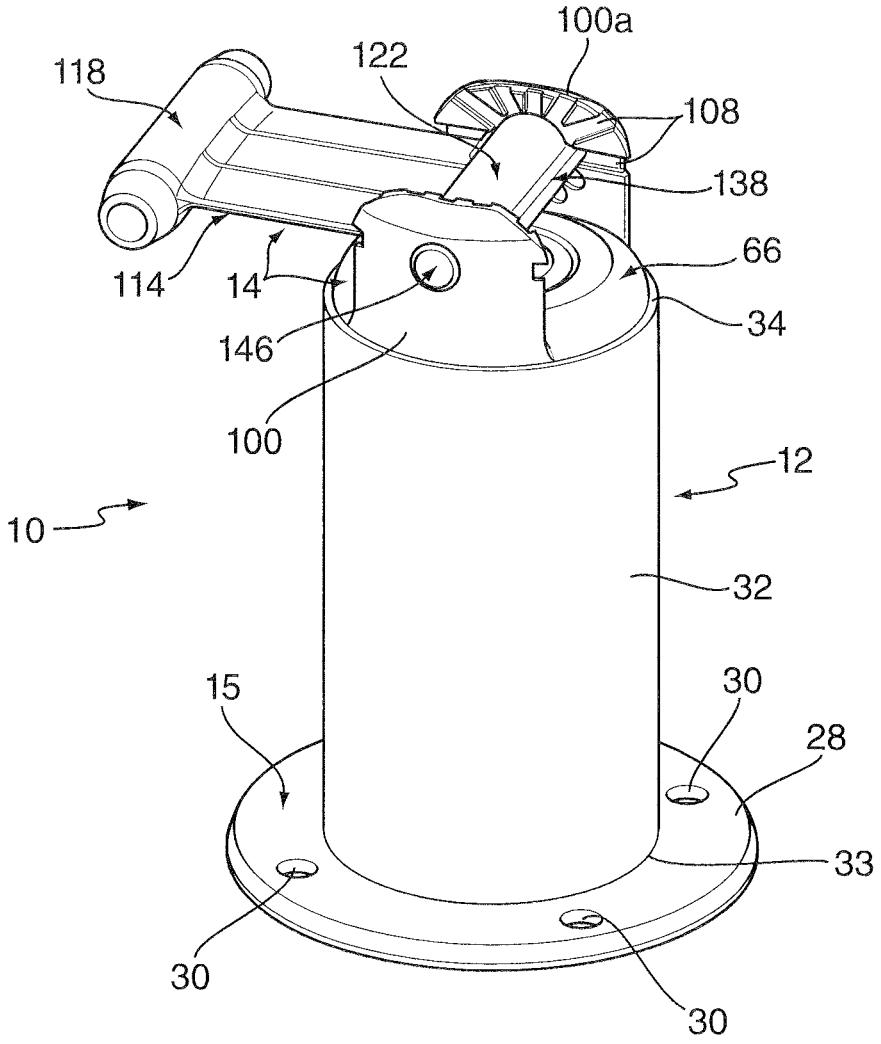
FIG. 4 is a perspective view of the support post assembly of FIG. 1 showing how the safety line mount has a mounting collar to which a safety line guide member is fixed at one of several preset angles, the safety line guide member thereby extending away from the support post, for example, in a radially extending position as drawn.

In FIGS. 1 to 3 the support post assembly 10 is shown with the safety line guide member 114 secured or arranged in a longitudinal orientation with respect to the support post 12. In FIG. 4, the support post assembly 10 is shown with the safety line guide member 114 oriented perpendicular to the longitudinal axis of the support post 12. In this orientation the ends 141, 141*a* of the ribs 136, 138 are held within the respective keyways 108, 108*a* that span the arms 100, 100*a* from one side edge 103 to the other 103*a*. As can be seen from the Figures, the inner surfaces 106, 106*a* of the arms 100, 1008 also include four other keyways 108, 108*a* oriented at an angle between the longitudinal and the transverse positions shown in FIGS. 1 and 4 in particular. In this example, the preset angles are 0°, ±30°, ±60° and ±90°, with respect to the longitudinal axis 24 of the support post 12. In other embodiments, different numbers of keyways 108, 108*a* may be provided at different orientations.

In use, the safety line 2 is retained within the bore 127 of the line keeper 118 and extends from each of the tapered ends 128, 128*a* towards a neighbouring support post assembly 10. Preferably the safety line 2 extends from the line keeper 118 in a direction proximate the longitudinal axis 129 of the line keeper so that the safety line does not wear against the edge of the bore 127 at either end 131, 131*a* of the line keeper 118.

Figure 8:
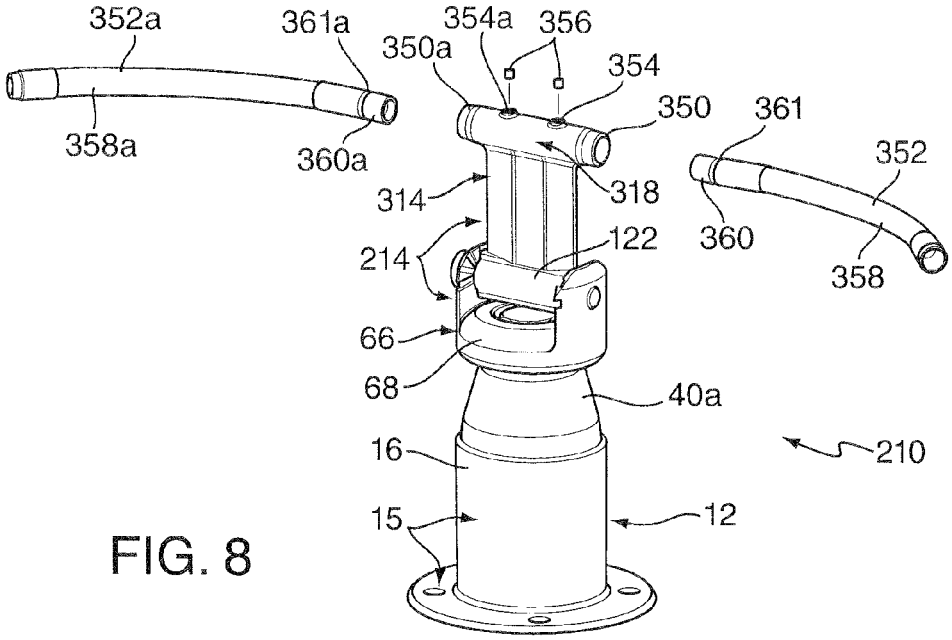
FIG. 8 is a partial exploded diagram of a safety line support post assembly according to a second preferred embodiment of the present invention, showing an alternative safety line guide member for use in the safety line mount of the present invention.
Figure 9:
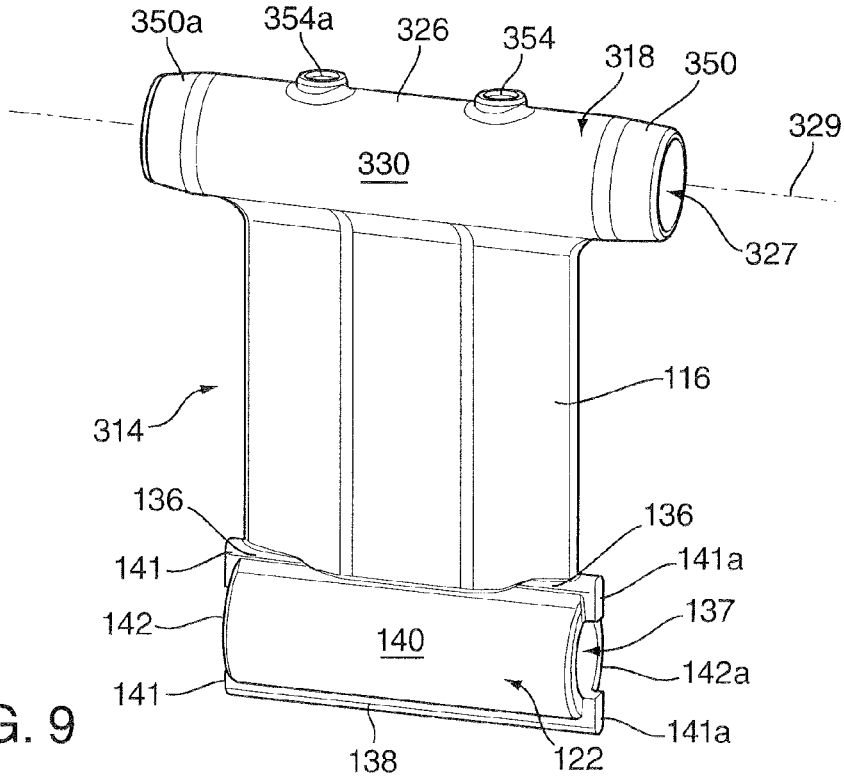
FIG. 9 is a perspective diagram of a safety line support showing the means of connection of guide arms to the guide member.

As such, in order to allow the safety line to pass smoothly around corners an alternative embodiment of the safety line mount is used when the safety line 2 has to change direction. An example of a support post assembly 210 incorporating this second embodiment of safety line mount 214 is shown in FIGS. 8 and 9. In the second embodiment of the invention 210, features the same as those of the first embodiment 10 are indicated using the same reference numerals, and features similar or analogous to features of the first embodiment of the invention are indicated by reference numerals incremented by 200. The support post assembly 210 has a support post 12 that is the same as the first embodiment and which would therefore include an outer sleeve the same as that 32 of the first embodiment, however, this outer sleeve is omitted from the view of FIG. 8 so that the other components of the support post 12 can be seen, in particular the inner sleeve 16 and the resilient insert 40*a* outside the base portion 15.

The support post assembly 210 has a safety line mount 214 with a mounting collar 66 that is the same as that for the first embodiment, but which differs from the first embodiment in the form of the safety line guide member 314 fitted to the mounting collar. FIG. 9 shows in greater detail the second embodiment of the safety line guide member 314, which has a generally rectangular stem 116 and a generally cylindrical key 122 attached at one end of the stem 116, as previously described.

A line keeper 318, attached to a second end of the stem 116 comprises a central cylindrical portion 326 having a constant external diameter and two end portions 350, 350*a* generally similar to those of the first embodiment. As in the first embodiment, a bore 327 of constant diameter extends centrally though the line keeper 318 along a longitudinal axis 329, and the stem 116 extends radially from an outer surface 330 of the central portion 326 of the line keeper 318, with the plane of the stem 116 parallel to the longitudinal axis 329 of the line keeper 318.

In this embodiment, the end portions 350, 350*a* do not taper significantly. In some cases the end portions 350, 350*a* are not tapered, and in other examples, the end portions 350, 350*a* are slightly tapered to smooth the transition between the keeper 318 and guide arms 352, 352*a* as will be described below.

The line keeper 318 differs from that of the first embodiment mainly in that this further comprises two threaded holes 354, 354*a* for receiving grub screws 356 or the like. Each of the holes 354, 354*a* is located proximate a respective end portion 350, 350*a*.

Each guide arm 352, 352*a* comprises a hollow, longitudinally curved tubular member 358, 358*a*, as shown in FIG. 8. At least an end region 360, 360*a* of each of the tubular members 358, 358*a* has an external diameter slightly smaller than the diameter of the bore 327 through the line keeper 318 such that there is a push fit of the end region 360, 360*a* of the guide arm 352, 352*a* into the respective end portion 350, 350*a* of the line keeper 318. When the guide arms 352, 352*a* are fully inserted in the line keeper 318, they are clamped in position by the grub screws 356 that are inserted in the holes 354, 354*a*. As the grub screws 356 are tightened they press into grooves 361, 361*a* in the outer surface of the guide arms 352, 352*a* within the bore 327 of the line keeper 318 and thereby retain the guide arms 352, 352*a* in position. In other embodiments, other retaining means may be used to retain the ends of the guide arms 352, 352*a* within the end portions 350, 350*a* of the line keeper 318.

In use, the safety line passes through a first of the two guide arms 352, through the bore 327 of the line keeper 318 and through the second of the two guide arms 352*a*. Due to the curvature of each of the guide arms 352, 352*a* a smooth bend is thereby formed in the safety line such that the direction in which the safety line enters a first one of the two guide arms 352 is different to the direction in which the safety line leaves the second of the two guide arms 352*a*. Each of the guide arms 352, 352*a* may have different curvatures, or alternatively, the guide arms 352, 352*a* may be identical.

Support post assemblies 210 comprising safety line mounts 214 that include the second embodiment of the safety line guide member 314 to which the curved guide arms 352, 352*a* are fitted are typically used at the corners of work areas or in positions in which the safety line has to pass around an obstacle.

It will be clear to a person of skill in the art that the support post assembly 10, 210 of the present invention does not have to be mounted to a floor or a horizontal surface, but may be mounted on a sloping or vertical surface such as the face of a wall, or an inverted surface such as a ceiling. As such the base portion 15 may not be located below the rest of the support post 12 when the support post assembly 10, 210 is mounted on a supporting surface.

The use of the support post assembly 10, 210 will now be described in relation to workers working at height on a platform. A number of support posts 12 are secured around the area of the platform, preferably in or proximate an edge region. The support posts 12 may be secured to a floor or to a wall for example. Depending on the specific locations of each of the support posts 12, it may be necessary to orient differently each or some of the safety line guide members 114, 314 in their keyways 108, 108*a*, to avoid obstacles for example, or to allow the safety line to be carried at different heights in different parts of the platform.

The safety line is passed through and received within the bores 127, 327 in the line keepers 118, 318, and optionally through one or more curved guide arms 352, so that the safety line is retained in position with respect to each of the support posts 12. A worker is attached to the safety line via a traveller which is able to slide along the safety line and pass over the line keepers 118, 318 as the worker moves around the work area. Although not shown, the traveller will have a slot greater that the thickness of the supporting stems 116, but less than the thickness of the line 2 so that the traveller remains secured to the line as the traveller passes over each support post assembly 10, 210.

If a worker falls, the energy of the fall is transmitted via the traveller to the safety line 2. This in turn applies a force to one or more of the line keepers 118, 318 through which the safety line passes. Because the safety line guide members 114, 314 are held rigidly within the mounting collar 66, the force that is applied to the safety line mount 14, 214 is transmitted to the support post 12. In particular a bending force is applied to the support post 12 due to the load being applied to the safety line mount 14, 214.

The bending force resulting from the rotation of the bolt 80 causes the resilient inserts 40, 40*a* in the support post 12 each to deform against the fixed, non-rotating end plate 20 of the inner sleeve 16, thereby absorbing in each of the inserts some of the energy of the fall. In particular, rotational movement of the safety line mount 14, 214 causes the body 68 of the mounting collar 66 to compress a portion of the upper insert 40*a*. Movement of the bolt 80 is constrained where this passes through the aperture 22 in the end plate. Movement of the bolt where this is seated in the mounting collar body 68 therefore results in the rotation of the bolt 80 about the aperture 22 in the end plate 20, and this additionally causes a diagonally opposite portion of the lower insert 40 to be compressed. The end plate 20 therefore acts as a pivot plate for the bolt 80. Deformation of the inserts 40, 40*a* may also include some sliding movement of the inserts 40, 40*a* with respect to the end plate 20. Sliding and deformation of the lower insert 40 is limited by the washer 88. In particular, at an extent of deformation, edges of one or more of the tabs 94 contact the inner surface 58 of the inner sleeve 16. Because the tabs 94 are angled with respect to the inner surface 58, the tabs 94 may be deformed slightly by the movement of the lower end 84 of the bolt 80 as one side of the tabs comes into contact with the inner surface 58 of the inner sleeve 16, however, the tabs 94 are designed to resist permanent deformation when subject to forces imparted during such a fall, and will thereby absorb more of the energy of the fall. The washer 88 with tabs 94 therefore forms an elastically deformable plate-like member which, in the event of a fall by a worker secured to the safety line, is forced against the base portion 15 of the support post 12, causing the deformable member to elastically deform and thereby absorb some of the energy of the fall.

In a preferred embodiment, the inner and outer sleeves 16, 32 are able to move with respect to each other so that during deformation of the inserts 40, 40*a* the sleeves 16, 32 are able to slide with respect to each other. This means that the sleeves 16, 32 only buckle at higher applied loads and preferably, during the fall of a worker, the sleeves 16, 32 only undergo elastic deformation and do not permanently deform.

The supports 10, 210 of the present invention, therefore act to absorb some of the energy of the fall of a worker through a transient deformation of the resilient inserts 40, 40*a* and optionally also a transient deformation of the tabs 94 of the washer 88 and sleeves 16, 32. This is in contrast to traditional support posts that hold the support line rigidly in position in a work area.

The support post assembly of the present invention, therefore, provides an improved safety line supportable to absorb some of the energy from the fall of a worker secured to the safety line.

It is to be recognized that various alterations, modifications, and/or additions may be introduced into the constructions and arrangements of parts described above without departing from the spirit or scope of the present invention, as defined by the appended claims.

The invention claimed is:

1. A support post assembly for supporting a fall safety line, the support post assembly comprising:

a support post having opposite first and second ends, an axis extending between said ends, and at said first end, a base portion for fixing the assembly to a supporting surface;

a safety line mount to which a safety line may be secured, the safety line mount extending away from the second end of the support post; and a shock absorber housed within the support post between said first and second ends, the shock absorber comprising a pivot, a first resilient block and a second resilient block, such that in the event of a fall by a worker secured to said safety line, lateral forces imparted to the safety line mount by the fall are transmitted to the shock absorber thereby causing the shock absorber to deflect laterally with respect to said axis, wherein the pivot is connected to the base portion and located between said first and second ends of the support post, said first and second resilient blocks of the shock absorber being located on, respectively, opposite first and second sides of the pivot, each of said resilient blocks having a pair of opposite end faces each of said end faces extending transversely to the axis of the support post, a first one of said end faces being fixed in place at said pivot and a second one of said end faces being free to rotate with respect to the pivot, said lateral deflection causing at least a part of both said first and second resilient blocks to rotate with respect to the pivot, and wherein deformation of each of said first and second resilient blocks of the shock absorber absorb energy from the fall.

2. A support post assembly as claimed in claim 1, in which the pivot comprises a pivot plate connected to the base portion and located between the first and second ends of the support post, the pivot plate having opposite first and second sides, the first resilient block of the shock absorber being located on the first side of the pivot plate and the second resilient block of the shock absorber being located on the second side of the pivot plate.

3. A support post assembly as claimed in claim 1, in which the shock absorber links the safety line mount to the base portion of the post.

4. A support post assembly as claimed in claim 2, in which the shock absorber links the safety line mount to the base portion of the post.

5. A support post assembly as claimed in claim 1, in which the safety line mount comprises a base plate, the base plate defining the second end of the support post, and the shock absorber linking the base plate to the base portion of the post.

6. A support post assembly as claimed in claim 1, in which the shock absorber further comprises a pin, the pin having opposite first and second ends, the pin being connected at said first end to the safety line mount and the pin extending through said first and second resilient blocks and engaging with the pivot, the pin pivoting with respect to the pivot in the event of a fall by a worker.

7. A support post assembly as claimed in claim 6, in which the base portion is connected to a plate and the pivot comprises an aperture in said plate, the pin passing through said aperture to form said pivot.

8. A support post assembly as claimed in claim 6, in which in the event of a fall by a worker secured to said safety line, the lateral forces imparted to the safety line mount cause the pin to rotate with respect to the pivot thereby transmitting said forces to said first and second resilient blocks such that said blocks absorb the energy of the fall.

9. A support post assembly as claimed in claim 7, in which in the event of a fall by a worker secured to said safety line, the lateral forces imparted to the safety line mount cause the pin to rotate with respect to the pivot thereby transmitting said forces to said first and second resilient blocks such that said blocks absorb the energy of the fall.

10. A support post assembly as claimed in claim 6, in which the shock absorber further comprises a deformable plate-like member attached at a second end of the pin, and wherein, in the event of a fall by a worker secured to said safety line, pivoting of the pin with respect to the pivot causes said deformable member to deform thereby absorbing the energy of the fall.

11. A support post assembly as claimed in claim 1, in which the support post assembly comprises a housing for the shock absorber, the housing having an inner surface inside of which the shock absorber is housed, each resilient block having, between said end faces, an outer surface, at least a portion of said outer surface being spaced apart from the inner surface of the housing to provide a cavity with space to permit the movement of said resilient blocks as said second end faces rotate with respect to the pivot.

12. A support post assembly as claimed in claim 1, in which parts of both said first and second resilient blocks of the shock absorber are compressed by said rotation as the shock absorber absorbs energy from the fall.

13. A support post assembly as claimed in claim 12, in which said first and second resilient blocks of the shock absorber are symmetrically disposed with respect to the pivot, and symmetrically opposite parts of said first and second resilient blocks of the shock absorber are compressed by said rotation as the shock absorber absorbs energy from the fall.

14. A support post assembly as claimed in claim 1, in which the support post has an outer sleeve, the outer sleeve extending around the base portion of the support post and extending away from the base portion towards the second end of the support post.

15. A support post assembly as claimed in claim 14, in which the outer sleeve makes a close sliding fit to the base portion of the support post.

16. A support post assembly as claimed in claim 15, in which the in which the safety line mount comprises a base plate, and the outer sleeve makes a close sliding fit to said base plate at the second end of the support post.

17. A support post assembly as claimed in claim 14, in which the safety line mount comprises a base plate, and the outer sleeve makes a close sliding fit to said base plate at the second end of the support post.

18. A support post assembly as claimed in claim 1, in which the safety line mount comprises a base plate, a stem and a line keeper for holding said safety line, and to which a safety line may be secured, the line keeper being spaced away from the base plate by means of the stem.

* * * * *